United States Patent [19]

Long

[11] 4,425,851

[45] Jan. 17, 1984

[54] HIGH SPEED PASSENGER TRANSFER VEHICLE

[76] Inventor: Alvin L. Long, Civilian Gen. Del. Beale A.F.B., Calif. 95903

[21] Appl. No.: 359,582

[22] Filed: Mar. 18, 1982

Related U.S. Application Data

[63] Continuation-in-part of Ser. No. 234,336, Feb. 17, 1981, abandoned.

[51] Int. Cl.[3] ..... B61K 1/00

[52] U.S. Cl. ..... 104/20; 104/89; 104/95; 104/122; 104/130; 296/178

[58] Field of Search ..... 104/18-21, 104/281-284, 27-29, 32 R, 32 A, 33, 89, 90, 94, 95, 96, 120, 122, 123, 130, 131, 138 R; 105/241.2; 296/179, 35.3, 164, 166, 167, 176, 178; 258/4, 8

[56] References Cited

U.S. PATENT DOCUMENTS

| | | | |
|---|---|---|---|
| 3,484,002 | 12/1969 | Barry | 104/20 X |
| 3,605,935 | 9/1971 | Gilbert | 104/89 X |
| 3,631,807 | 1/1972 | Cherto | 104/94 X |
| 3,640,227 | 2/1972 | Webb | 104/130 |
| 3,779,596 | 12/1973 | Ritter | 296/35.3 X |
| 4,082,042 | 4/1978 | Barry | 104/122 X |

FOREIGN PATENT DOCUMENTS

| | | | |
|---|---|---|---|
| 2510248 | 9/1976 | Fed. Rep. of Germany | 104/20 |

*Primary Examiner*—Joseph F. Peters, Jr.
*Assistant Examiner*—Mitchell J. Hill

[57] ABSTRACT

Disclosed is a self-propelled suspension monorail vehicle carried on top of a nonstop train. At depots the monorail vehicle attaches itself to a suspended monorail by way of an attachable drive mechanism.

Passengers leaving the nonstop train have access to the monorail vehicle by way of a stairway that extends through a magnetic collar that connects the bottom of the monorail vehicle to the top of the nonstop train. Horizontal sliding doors seal the bottom of the monorail vehicle and the top of the nonstop train during a separation or retrieving maneuver.

2 Claims, 10 Drawing Figures

HIGH SPEED PASSENGER TRANSFER VEHICLE

This is a continuation-in-part of application Ser. No. 234,336 filed Feb. 17, 1981, now abandoned.

SUMMARY OF THE DISCLOSURE

The present invention relates to transferring passengers to or from a nonstop train without stopping the train. A nonstop train as defined in this disclosure is a train that travels between distant major depots at high speed without stopping at minor depots.

The prior art indicates several methods of transferring passengers to or from a nonstop train. However all of these methods require a slowing downof the nonstop train to facilitate a transfer of passengers.

The object of the present invention is to provide a means of transferring passengers to or from a high speed nonstop train at any speed.

The present invention is a self-propelled nonorail vehicle carried on top of a nonstop train. At depots the monorail vehicle attaches itself to a monorail as it magnetically releases itself from the nonstop train. The monorail, now free from the nonstop train, can deliver people anywhere in or around a depot.

To place people on the nonstop train the monorail vehicle matches the speed of the nonstop train in an overhead position. A magnetic collar-doorway on the top of the nonstop train attaches itself to a magnetic collar-doorway on the bottom of the monorail vehicle as the monorail vehicle releases its drive mechanism from the monorail.

The present invention is considered an improvement in the art because passengers can transfer to or from a nonstop train at high speed.

DETAILED DESCRIPTION OF THE DRAWINGS

Figure 1:
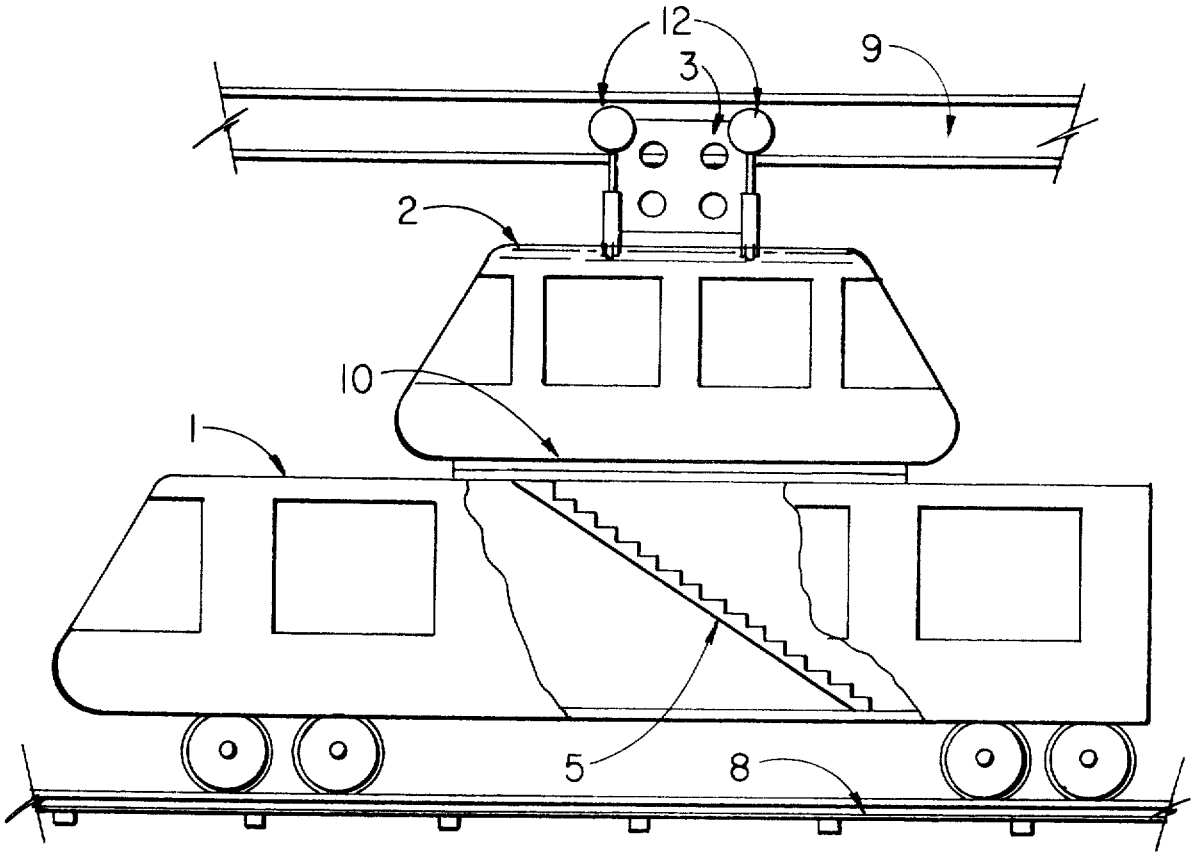
FIG. 1 shows a self-propelled monorail vehicle resting on top of a nonstop train.
Figure 6:
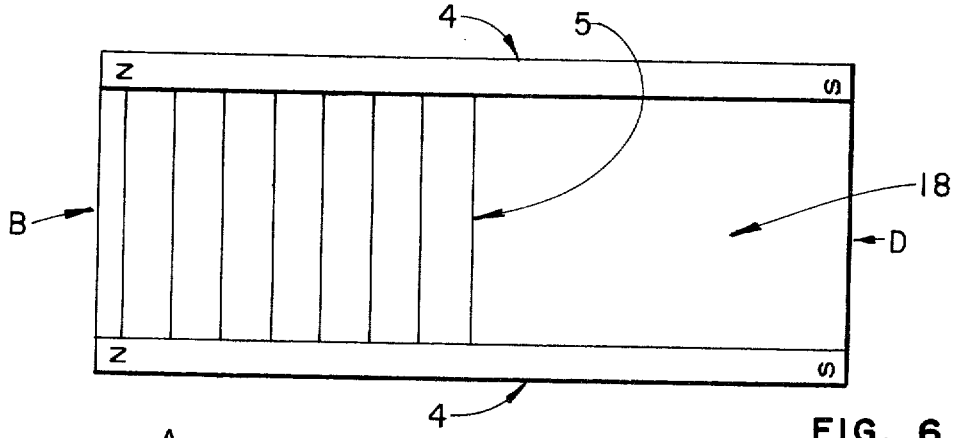
FIG. 6 is a top view of the magnetic collar-doorway on the top of the nonstop train.
Figure 7:
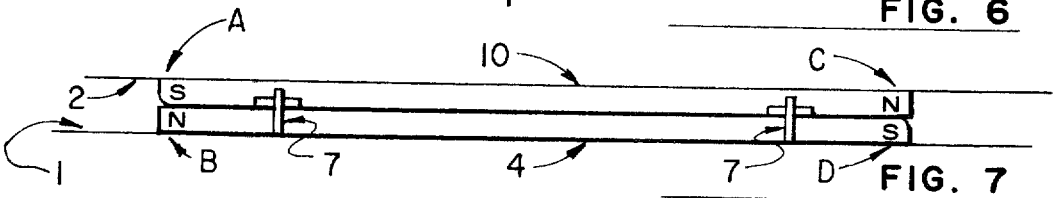
FIG. 7 is a side view of FIG. 5 and FIG. 6 and shows how they are joined together magnetically and with shackles.

In the drawings FIG. 1 shows a self-propelled monorail vehicle 2 mounted on a nonstop train 1. The monorail vehicle 2 has a magnetic collar-doorway 10 built into its bottom. The nonstop train has a magnetic collar-doorway 4 built into its top. The magnetic collar-doorway 10 of the monorail vehicle and the magnetic collar-doorway of the nonstop train 4 act as a cradle for the monorail vehicle 2. FIG. 7 is a side view of the magnetic collars 10 and 4. The collars 4 and 10 consist of two parallel bar magnets each. One magnet on each side of the doorways shown in FIGS. 5-6 and 9-10. The magnets are electric and are used as a means of releasing or connecting the monorail vehicle 2 to the nonstop train 1.

Figure 2:
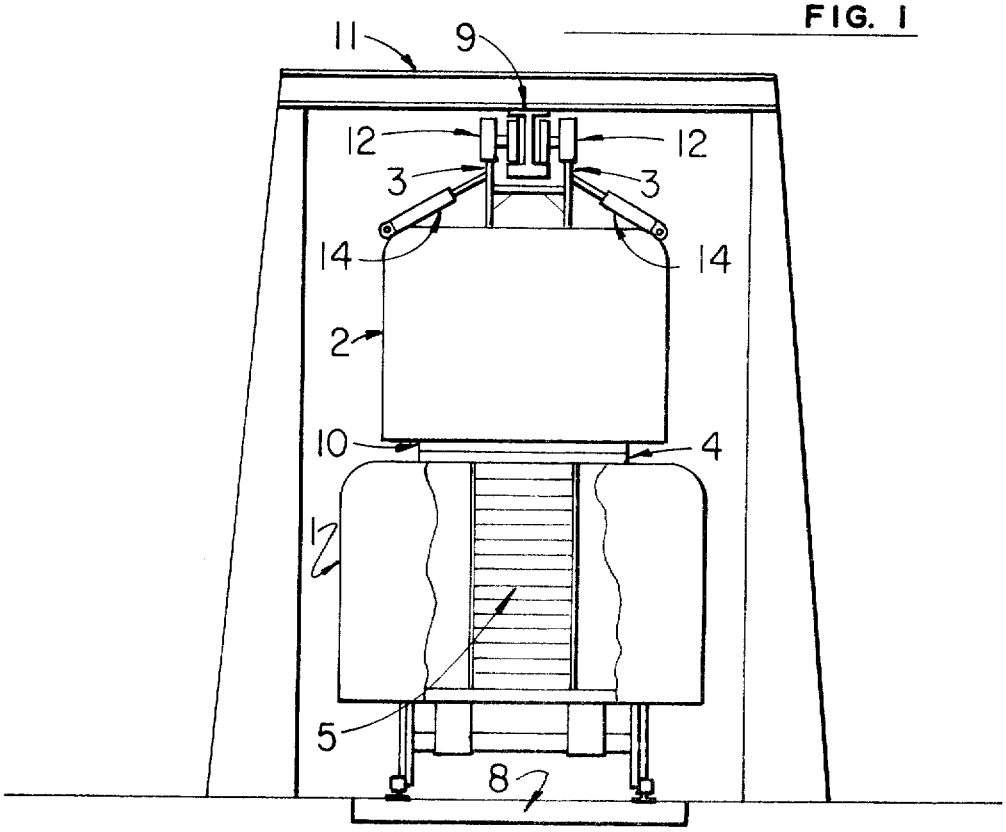
FIG. 2 is an end view of FIG. 1

For example as the nonstop train 1 approaches a depot a secondary monorail system 9 runs parrallel to the main system 8 tracks for some distance, in this example directly above it as shown in FIGS. 1-2.

The monorail vehicle 2 has a drive mechanism 3 on top. The drive mechanism hinges sideways when not in use, see FIG. 3. The left-hand drive machanism 3 for example is shown disconnected from the monorail 9. The right hand drive mechanism 3 for example is shown in contact with the monorail 9. In real use both right and left drive mechanisms 3 work together in connecting or disconnecting the monorail vehicle 2 to or from the monorail 9. The drive mechanism 3 has hydraulic cylinders 14-15 to lift and pull away the drive mechanism 3 from the monorail 9 during a separation maneuver, or during a receiving maneuver the hydraulic cylinders 14-15 push in and pull down on the drive mechanism 3 in a connecting maneuver.

Figure 4:
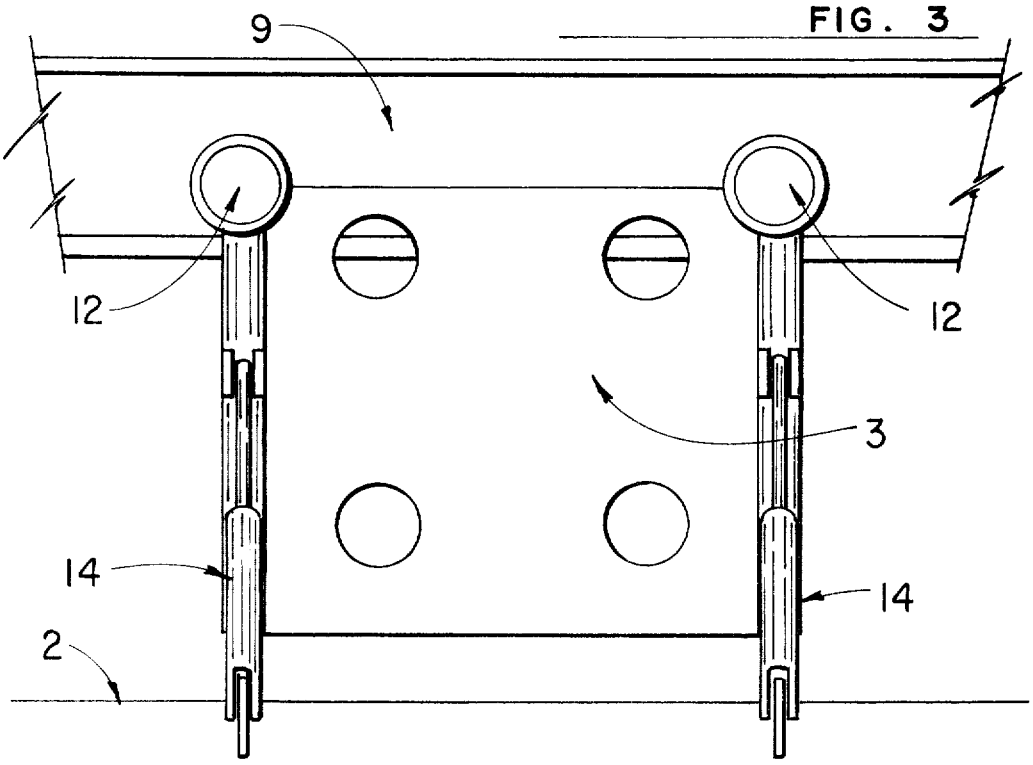
FIG. 4 is a side view of FIG. 3.
Figure 5:
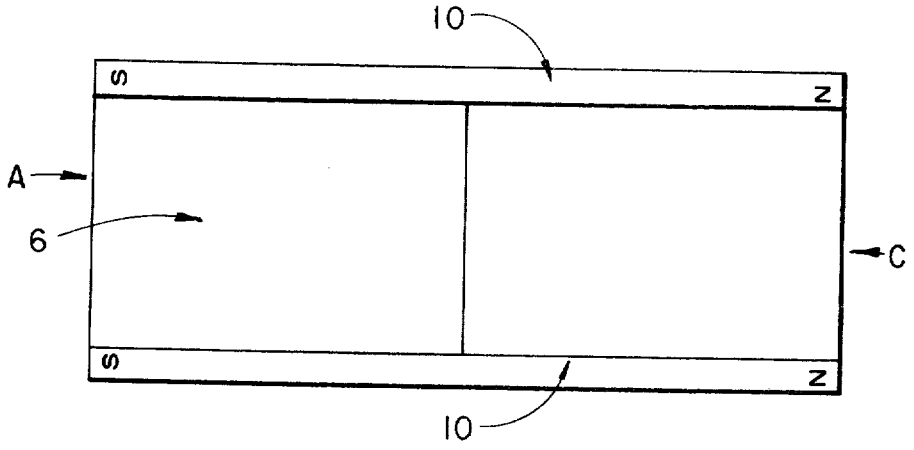
FIG. 5 is a top view of the magnetic collar-doorway on the bottom of the monorail vehicle.
Figure 8:
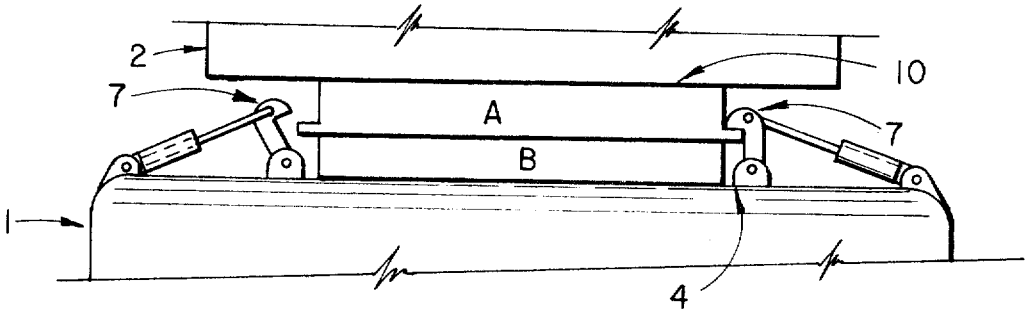
FIG. 8 is an end view of FIG. 7.
Figure 9:
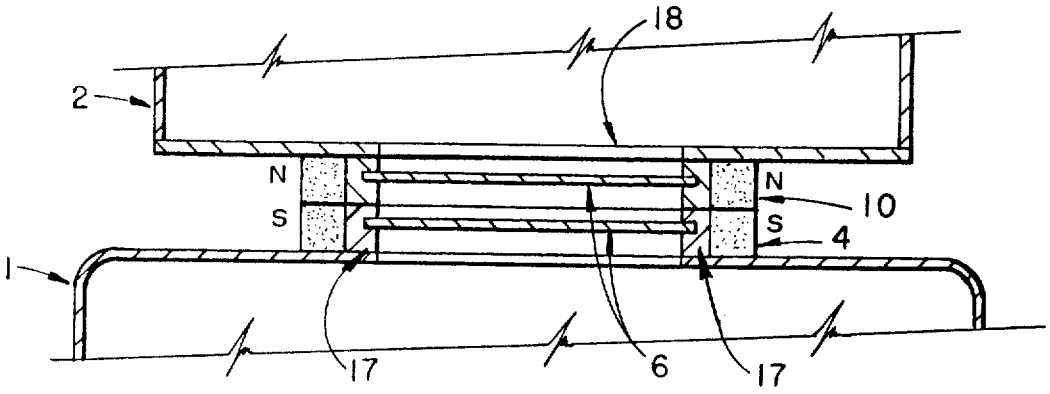
FIG. 9 is an end view of FIG. 8 in cross section and shows the position of the sliding doors.

The drive mechanism 3 has electric motors 12 to rotate the drive wheels 13. In a separation maneuver the drive mechanism 3 is pushed against the monorail 9 by hydraulic arms at 14. The shackles 7 are released at this point. Only the magnetic bars N-S are holding the monorail vehicle 2 on the nonstop train 1. Hydraulic cylinders 15 are pulled down which engages the drive wheels 13 with the monorail 9, at this point the bar magnets N-S are turned off releasing the monorail from the nonstop train 1. The monorail vehicle 2 is now free to follow the monorail 9 to a depot. To place the monorail vehicle 2 on a nonstop train 1 the monorail vehicle 2 is brought up to the speed of the nonstop train 1 as shown in FIGS. 1-2. As the monorail vehicle 2 overtakes the nonstop train 1 the bar magnets are turned on, the bar magnets N-S in FIG. 5 are on the monorail vehicle 2. The bar magnets N-S in FIG. 6 are on the nonstop train, as FIG. 5 overtakes FIG. 6 the south poles FIG. 5 are in opposition to the south poles of FIG. 6 causing them to repel each other somewhat. In doing so the monorail vehicle 2 is pushed up somewhat momentarily until it advances far enough for the south poles to be attracted to the north poles of the nonstop train 1. As the two sets of bar magnets firmly seat the hydraulic shackles 7 are engaged, see FIGS. 7-8. With the shackles 7 holding the monorail vehicle 2 to the non-stop train 1 the drive mechanism 3 is released from the monorail 9 by extending the hydraulic cylinders 15, see FIGS. 3-4. Extending the hydraulic cylinders 15 pushes the drive mechanism 3 up which disengages the drive wheels 13 from the monorail 9.

Retracting the hydraulic cylinders 14 pulls the drive mechanism 3 away from the monorail 9 which completes the disengagement maneuver. A conductor of the monorail vehicle 2 has an appropriate hydraulic and electric control system for operating the monorail vehicle 2.

Figure 10:
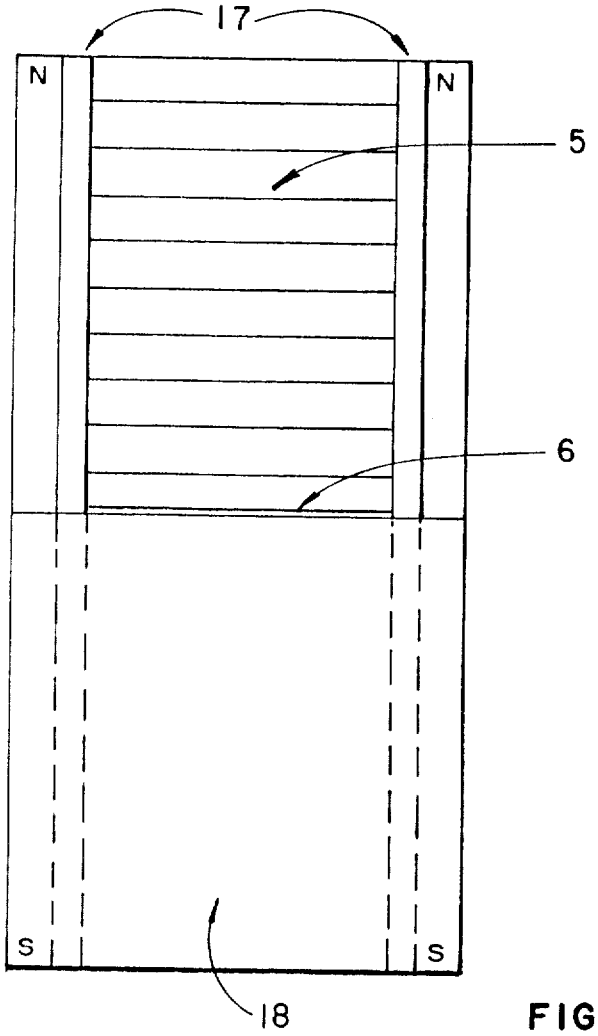
FIG. 10 is a top view of FIG. 9.

A stairway 5 (see FIG. 1) in the non-stop train 1 allows passengers access to the monorail vehicle 2 through the magnetic collars 4 and 10, (see FIGS. 5-6 and 9-10). The magnetic collar 10 of the monorail vehicle 2 fits on top of the magnetic collar 4 of the nonstop train, (see FIG. 9). Sliding doors 6 are shown in horizontal door guides 17 mounted between the bar magnets N-S or magnetic collars 4, 10, (end view). FIG. 10 is a top view of the magnetic collar 10 of the monorail vehicle 2 and shows the stairs 5, door guides 17, door 6 open and shown under a floor panel 18.

FIG. 2 shows a support structure 11 holding up the monorail 9.

Figure 3:
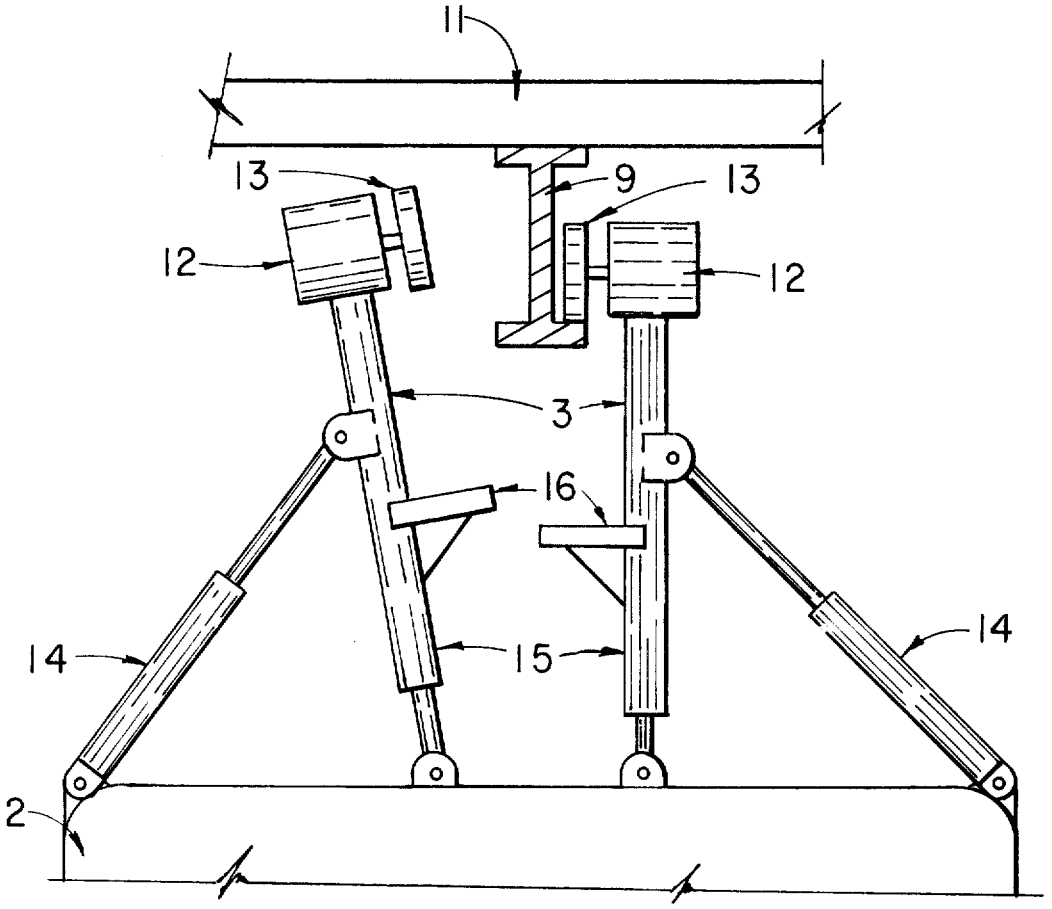
FIG. 3 shows the drive mechanism on top of the monorail vehicle, end view.

FIG. 3 shows spacer guide arms 16 to hold the right hand drive mechanism 3 against the left-hand drive mechanism 3 at exactly the right distance apart.

What is claimed is:

1. In a high-speed train that is supported by track, the improvement comprising;

(1) a self-propelled vehicle, carried on top of said train and adapted to be suspended on a monorail at a depot, for subsequent release from said train;

(2) a magnetic collar means on the bottom of said self-propelled vehicle, and on the top of said train, said magnetic collar means adapted to hold said self-propelled vehicle to the top of said train;

(3) means for transferring passengers to and from said train, said transferring means comprising;

(A) a stairway means extending from said train to said self-propelled vehicle to allow access to passengers between said train and said self-propelled vehicle via said magnetic collar means;

(B) a horizontal sliding door means mounted in said magnetic collar means between said train and said self-propelled vehicle;

(4) power driven wheel means mounted on retractable arms on said self-propelled vehicle, said power driven wheel means on said vehicle adapted to be extended to securely grasp said monorail at a train depot;

(5) shackle means mounted on said train on retractable arms to hold said self-propelled vehicle to said train during normal travel between depots, said shackle means adapted to be released to permit release of said self-propelled vehicle from said train at a train depot;

whereby said self-propelled vehicle is detached from said train and attached to said monorail at a train depot in preparation to discharge passengers ascended from said train to said vehicle via said stairway means through said magnetic collar means.

2. The invention as defined in claim 1, wherein said vehicle is adapted to be released from said monorail and attached to said train at a depot to permit passengers alighting thereon to descend into said train via said stairway for travel between depots.

* * * * *